US010900280B2

(12) United States Patent
Smith et al.

(10) Patent No.: US 10,900,280 B2
(45) Date of Patent: Jan. 26, 2021

(54) ARCHITECTURAL STRUCTURE COVERING HAVING A SPEED REGULATING ASSEMBLY

(71) Applicant: HUNTER DOUGLAS INC., Pearl River, NY (US)

(72) Inventors: Stephen P. Smith, Sandy Springs, GA (US); Kenneth M. Faller, Thornton, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 268 days.

(21) Appl. No.: 16/115,769

(22) Filed: Aug. 29, 2018

(65) Prior Publication Data

US 2019/0085632 A1 Mar. 21, 2019

Related U.S. Application Data

(60) Provisional application No. 62/560,814, filed on Sep. 20, 2017.

(51) Int. Cl.

| | |
|---|---|
| ***E06B 9/88*** | (2006.01) |
| ***E06B 9/72*** | (2006.01) |
| ***E06B 9/80*** | (2006.01) |

(52) U.S. Cl.

CPC ..... *E06B 9/88* (2013.01); *E06B 9/72* (2013.01); *E06B 9/80* (2013.01); *E06B 2009/802* (2013.01); *E06B 2009/807* (2013.01)

(58) Field of Classification Search

CPC ..... E06B 9/88; E06B 2009/807; E06B 9/72; E06B 9/80; E06B 2009/802

(Continued)

(56) References Cited

U.S. PATENT DOCUMENTS

| | | | |
|---|---|---|---|
| 4,125,142 | A | 11/1978 | Fohl |
| 5,203,392 | A | 4/1993 | Shea |

(Continued)

FOREIGN PATENT DOCUMENTS

| | | | |
|---|---|---|---|
| EP | 0628689 | A2 | 12/1994 |
| EP | 1327744 | A1 | 7/2003 |

(Continued)

*Primary Examiner* — Beth A Stephan

(74) *Attorney, Agent, or Firm* — Kacvinsky Daisak Bluni PLLC

(57) ABSTRACT

A speed regulating assembly for coupling to a roller tube for regulating a deployment speed of a covering of an architectural-structure covering is disclosed. The speed regulating assembly may include a detachable adapter for enabling a singular sized speed regulating device to be used regardless of the size of the roller tube. That is, by utilizing a detachable adapter for coupling to the roller tube, any change in the size of the roller tube only requires a different sized adapter. In addition, the speed regulating assembly may be configured so that during covering retraction, the speed regulating assembly is disengaged so that any input rotation from the roller tube is not transmitted to the speed regulating device. However, during covering deployment, the speed regulating assembly is engaged so that any input rotation from the roller tube is transmitted to the speed regulating device thereby regulating the speed of covering deployment.

31 Claims, 14 Drawing Sheets

(58) Field of Classification Search
USPC ..... 160/294
See application file for complete search history.

(56) References Cited

U.S. PATENT DOCUMENTS

| | | | | |
|---|---|---|---|---|
| 5,386,891 | A | 2/1995 | Shea | |
| 5,460,252 | A | 10/1995 | Kosugi et al. | |
| 6,123,134 | A | 9/2000 | Thomas et al. | |
| 6,685,592 | B2 | 2/2004 | Fraczek et al. | |
| 6,729,447 | B2 | 5/2004 | Takahashi | |
| 6,981,539 | B2 | 1/2006 | Fraczek | |
| 8,220,603 | B2 | 7/2012 | Cultraro | |
| 8,356,653 | B2 | 1/2013 | Fu-Lai et al. | |
| 8,746,320 | B2 | 6/2014 | Yu et al. | |
| 9,038,800 | B2 | 5/2015 | Dang | |
| 9,062,492 | B2 | 6/2015 | Yu et al. | |
| 9,127,500 | B2 | 9/2015 | Huang | |
| 9,260,912 | B2 | 2/2016 | Huang | |
| 9,677,332 | B2 | 6/2017 | Waehrisch et al. | |
| 2006/0272783 | A1† | 12/2006 | Smith | |
| 2008/0257504 | A1* | 10/2008 | Marchetto | E06B 9/88 160/311 |
| 2009/0078380 | A1 | 3/2009 | Cheng | |
| 2015/0028144 | A1 | 1/2015 | Defenbaugh et al. | |
| 2015/0308188 | A1 | 10/2015 | Lin et al. | |
| 2017/0201140 | A1* | 7/2017 | Cole | E06B 9/72 |
| 2017/0211321 | A1† | 7/2017 | Chen | |
| 2017/0226799 | A1* | 8/2017 | Hebeisen | E06B 9/42 |
| 2018/0106107 | A1* | 4/2018 | Smith | E06B 9/42 |

FOREIGN PATENT DOCUMENTS

| | | | |
|---|---|---|---|
| EP | 1643077 | A2 | 4/2006 |
| EP | 3056652 | A1 | 8/2016 |
| JP | 2016211175 | A | 12/2016 |
| WO | 2007019433 | A2 | 2/2007 |
| WO | 2008/123162 | A1 | 10/2008 |
| WO | 2011/105984 | A1 | 9/2011 |
| WO | 2012/026912 | A1 | 3/2012 |
| WO | 2012093934 | A1 | 7/2012 |
| WO | 2016/009880 | A1 | 1/2016 |
| WO | 2016/009881 | A1 | 1/2016 |
| WO | 2016131087 | A1 | 8/2016 |
| WO | 2016/186064 | A1 | 11/2016 |

* cited by examiner
† cited by third party

ARCHITECTURAL STRUCTURE COVERING HAVING A SPEED REGULATING ASSEMBLY

CROSS-REFERENCE TO RELATED APPLICATIONS

This is a non-provisional of, and claims the benefit of the filing date of, U.S. provisional patent application No. 62/560,814, filed Sep. 20, 2017, titled "Architectural Structure Covering Having a Speed Regulating Assembly", the entirety of which application is incorporated by reference herein.

FIELD OF THE DISCLOSURE

The present disclosure relates generally to the field of architectural-structure coverings, and relates more particularly to a speed regulating assembly for use in an architectural-structure covering for coupling to a roller tube to regulate a deployment speed of a covering portion of the architectural-structure covering.

BACKGROUND

Architectural-structure coverings may selectively cover an architectural structure such as a window, a doorway, a skylight, a hallway, a portion of a wall, etc. Generally speaking, architectural-structure coverings may include a covering that can be vertically extendable (or deployable), and retractable (e.g., able to be lowered or raised, respectively) relative to a horizontally-oriented head rail between an extended (or deployed) position and a retracted position for obscuring and exposing an underlying architectural structure, such as, for example, a window, respectively. The architectural-structure covering may further include a rigid bottom rail attached to a lower edge of the covering. The bottom rail may be utilized to add weight along the bottom edge of the covering to encourage the covering to drop by gravity during deployment.

The architectural-structure covering may also include a speed regulating device operable during deployment of the covering to limit or reduce the speed by which the covering extends or deploys. That is, depending on the material of the covering and the weight of the bottom rail, if unrestrained, the covering may deploy at a greater than desirable speed during deployment. To control the deployment speed, the architectural-structure covering may incorporate a speed regulating device, for example, within the roller tube.

One common problem with incorporating speed regulating devices in such a manner is that conventional speed regulating devices are coupled to the inner surface of the roller tube, thus depending on the architectural-structure covering being used, a different size roller tube and hence a different sized speed regulating device may be required. For example, a different speed regulating device may be required for every sized roller tube, thus, adding to the overall number of required components that must be stocked.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is a speed regulating assembly used to couple to a roller tube to regulate a deployment speed of a covering portion of an architectural-structure covering. In use, the speed regulating assembly includes a speed regulating device. The speed regulating device may be any now known or hereafter developed speed regulating device for regulating, controlling or limiting, for example, the speed of the covering during deployment. However, in contrast to known speed regulating devices that directly couple to the roller tube, for example, the inner surface of the roller tube, so that any change in diameter of the roller tube requires a different sized and/or shaped speed regulating device to be used, the speed regulating assembly of the present disclosure may include a detachable adapter component arranged and configured to couple to the roller tube, for example, the inner surface of the roller tube. In this manner, by utilizing a speed regulating assembly having an adapter component, any change in the size or diameter of the roller tube can be accommodated by a different sized adapter assembly or component. As such, a singular speed regulating device may be used regardless of the size or inner diameter of the roller tube.

In addition, the speed regulating assembly may be arranged and configured so that, in use, during covering retraction, a component of the speed regulating assembly may be disengaged so that any input rotation from the roller tube is not transmitted to the speed regulating device. As such, the speed regulating device has little to no influence during covering retraction. However, during covering deployment, a component of the speed regulating assembly may be engaged so that any input rotation from the roller tube is transmitted to the speed regulating device. As such, during covering deployment, the speed regulating assembly is engaged to regulate, control, or limit the speed of covering deployment, as would be appreciated by one of ordinary skill in the art.

DETAILED DESCRIPTION

Figure 1:
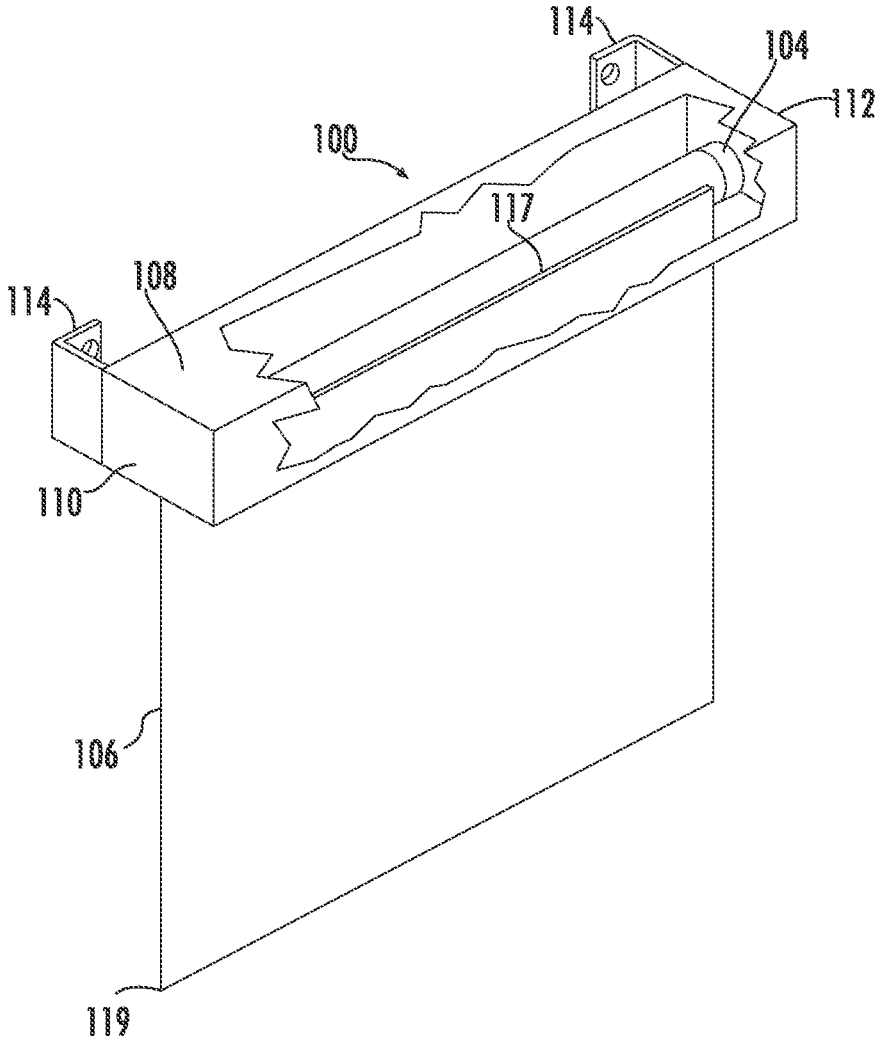
FIG. 1 is front perspective view illustrating an example embodiment of an architectural-structure covering assembly including a covering shown in an extended position.

Embodiments of a speed regulating assembly in accordance with the present disclosure will now be described more fully hereinafter with reference to the accompanying drawings, in which preferred embodiments of the present disclosure are presented. In one embodiment, the speed regulating assembly may include an adapter component or assembly for coupling to a roller tube of an architectural-structure covering. The speed regulating assembly of the present disclosure may, however, be embodied in many different forms and should not be construed as being limited to the embodiments set forth herein. Rather, these embodiments are provided so that this disclosure will convey certain example aspects of the speed regulating assembly to those skilled in the art. In the drawings, like numbers refer to like elements throughout unless otherwise noted.

As will be described in greater detail below, the speed regulating assembly of the present disclosure may be used in connection with an architectural-structure covering, for example, a roller-type architectural-structure covering, as shown in FIG. 1. In use, the speed regulating assembly couples to a roller tube of the architectural-structure covering. That is, in use, an adapter assembly or component of the speed regulating assembly couples or engages (used interchangeably herein without the intent to limit) with the roller tube of the architectural-structure covering to regulate the speed of the covering portion during deployment, extension, or lowering.

As will be described in greater detail below, the speed regulating assembly may be used with any speed regulating device now known or hereafter developed for regulating, controlling, or limiting (used interchangeably herein without the intent to limit), for example, the speed of the covering during deployment. In contrast with known speed regulating devices that directly couple to the roller tube (for example, couple with the inner surface of the roller tube) such that any change in diameter of the roller tube requires a different size or shaped speed regulating device to be used, the speed regulating assembly of the present disclosure includes a detachable adapter arranged and configured to couple with the roller tube, for example, the inner surface of the roller tube. That is, the adapter may be removably coupled with the speed regulating assembly. In this manner, by utilizing the speed regulating assembly, any change in the size or diameter of the roller tube only requires a different-sized adapter.

By utilizing an adapter to couple to the roller tube, the manufacturer does not need to maintain an independent and separate speed regulating device for each roller tube size. That is, by utilizing a speed regulating assembly, a singular speed regulating device may be used regardless of the size or inner diameter of the roller tube. As such, in use, the manufacturer, when assembling the architectural-structure covering, can select an adapter sized to fit a particular roller tube. In this manner, a universal speed regulating device having a detachable adapter assembly or component can be manufactured and used for all roller tube sizes. As such, for example, a manufacturer may build, store, etc. a single speed regulating device regardless of the size or inner diameter of the roller tube, thus minimizing the number of different items required to be stocked.

In addition, as will be described in greater detail below, in one example embodiment, the speed regulating assembly is arranged and configured so that, in use, during covering retraction, the speed regulating assembly is disengaged so that any input rotation from the roller tube is not transmitted to the speed regulating device. As such, the speed regulating device has little to no influence during covering retraction. However, during covering deployment, the speed regulating assembly is engaged so that any input rotation from the roller tube is transmitted to the speed regulating device. As such, during covering deployment, the speed regulating assembly is engaged to regulate, control, or limit the speed of covering deployment, as would be appreciated by one of ordinary skill in the art.

In one example embodiment, the speed regulating assembly is arranged and configured so that when rotated in a first direction to deploy the covering of the architectural-structure covering, the roller tube transmits the torque to the adapter assembly or component, which transmits the torque to the speed regulating device to control the deployment speed of the covering. Alternatively, when rotated in a second direction to retract the covering of the architectural-structure covering, the roller tube transmits the torque to the adapter assembly or component. However, in this second direction, the torque is not transmitted to the speed regulating device. That is, as will be described in greater detail below, at least a portion of the speed regulating assembly is disengaged so that the input torque received by the adapter assembly or component is not transmitted as an output torque to the speed regulating device.

In one example embodiment, a speed regulating assembly is disclosed. The speed regulating assembly may be used with an architectural-structure covering to couple to a roller tube to regulate a speed of a covering portion of the architectural-structure covering. The speed regulating assembly includes a speed regulating device and an adapter. In use, the adapter couples to the roller tube so that rotation of the roller tube is transmitted to the adapter. The adapter is detachably coupleable to the speed regulating device so that the adapter can be selectively coupled and decoupled from the speed regulating device.

In another example embodiment, an architectural-structure covering is disclosed. The architectural-structure covering includes a covering portion, a roller tube coupled to the covering portion for retracting and deploying the covering portion, a speed regulating device for regulating a speed of the covering portion, and an adapter. In use, the adapter couples to the roller tube so that rotation of the roller tube is transmitted to the adapter. The adapter is detachably coupleable to the speed regulating device so that the adapter can be selectively coupled and decoupled from the speed regulating device.

In one example embodiment, the adapter includes a plurality of radially extending arms for coupling with an inner surface of the roller tube. The speed regulating assembly includes a cam bushing for coupling to the adapter by, for example, a snap-fit connection. The cam bushing is also rotatably coupled to the adapter so that rotation of the adapter is transferred to the cam bushing. For example, the cam bushing may include a plurality of splines for coupling to corresponding splines located on the adapter.

In one example embodiment, the speed regulating assembly is arranged and configured so that when the adapter is rotated in a first direction, the speed regulating assembly is in an activated configuration or state (configuration and state used interchangeably herein without the intent to limit) such that any input rotation to the adapter is transmitted to the speed regulating device. The speed regulating assembly is also arranged and configured so that when the adapter is rotated in a second direction opposite the first direction, the speed regulating assembly is in a deactivated configuration such that any input rotation to the adapter is not transmitted to the speed regulating device.

In one example embodiment, the speed regulating assembly also includes a clutch element. In use, the clutch element is rotationally coupled to the adapter so that rotation of the adapter is transferred to the clutch element. The clutch element is selectively coupled to the speed regulating device so that rotation of the clutch element is transmitted to the speed regulating device when in the activated configuration. Additionally, when in the deactivated configuration, the clutch element is rotationally disengaged with respect to the speed regulating device so that rotation of the clutch element is not transmitted to the speed regulating device.

In one example embodiment, the speed regulating device also includes a cam bushing. The cam bushing includes a pair of axially extending cam members so that rotation of the cam bushing in the first direction causes the cam members to interact with the clutch element so the said clutch element is rotationally coupled to the speed regulating device, and rotation of the cam bushing in the second direction causes the cam members to interact with the clutch element so that the clutch element is rotationally disengaged from the speed regulating device. In one example embodiment, the clutch element includes a body including an outer surface, first and second resilient arms (each arm including a connected end and a free end), and first and second pair of shoulders formed on the outer surface of the body. The speed regulating device also includes a first housing, wherein, when in the deactivated configuration, the cam members contact the second pair of shoulders formed on the body of the clutch element so that the first and second resilient arms remaining in a non-expanded state and, as such, do not engage the first housing. However, when in the activated configuration, the cam members interact with the first and second resilient arms to force the first and second resilient arms outwards into engagement with the first housing so that rotation of the clutch member rotates the first housing.

In one example embodiment, the speed regulating device also includes a second housing. The first housing including a hollow interior cavity for receiving at least a portion of the second housing and at least a portion of the speed regulating device. In use, the first housing is rotationally coupled to the speed regulating device so that rotation of the first housing is transmitted to the speed regulating device. The second housing is rotationally fixed with respect to the first housing.

Disclosed herein is also a kit for a speed regulating assembly for use in an architectural-structure covering to couple to a roller tube to regulate a speed of a covering portion of the architectural-structure covering. In one example embodiment, the kit includes a speed regulating device for regulating the speed of the covering portion of the architectural-structure covering, a speed regulating assembly for selectively coupling the speed regulating device to the roller tube, and first and second adapters for coupling to the roller tube. The first and second adapters are selectively, detachably coupleable to the speed regulating assembly to accommodate various sized roller tubes. The first adapter is sized and configured to couple the speed regulating assembly to a roller tube having a first diameter, while the second adapter is sized and configured to couple the speed regulating assembly to a roller tube having a second diameter.

In another example embodiment, the speed regulating assembly is a tube-engaging element for coupling to a roller tube, and a speed regulating engaging element for coupling to a speed regulating device. In use, the speed regulating assembly has an activated configuration and a deactivated configuration. In the activated configuration, the speed regulating assembly is arranged and configured so that any input rotation from the roller tube to the tube-engaging element is transmitted to the speed regulating engaging element and to the speed regulating device. In the deactivated configuration, the speed regulating assembly is arranged and configured so that any input rotation from the roller tube to the tube-engaging element is not transmitted to the speed regulating engaging element and to the speed regulating device.

Referring to FIG. 1, a front view of an example architectural-structure covering 100 is shown. As shown, the architectural-structure covering assembly 100 may include a headrail 108, which in the illustrated embodiment is a housing having opposed end caps 110, 112 joined by front, back, and top sides to form an open bottom enclosure. The headrail 108 may include mounts 114 for mounting the architectural-structure covering assembly 100 to a wall or other structure. Although a particular example of a headrail 108 is shown in FIG. 1, many different types and styles of headrails exist and could be employed in place of the example headrail of FIG. 1.

The architectural-structure covering assembly 100 may also include a roller tube 104 rotatably coupled between the end caps 110, 112, and a covering 106. As will be readily appreciated by one of ordinary skill in the art, the covering 106 of the architectural-structure covering 100 is suspended from the roller tube 104 and may be configured to be vertically extended and retracted relative to the head rail 108 between an extended position (shown in FIG. 1), wherein the covering 106 may partially or entirely cover an architectural structure such as a window, a doorway, a skylight, a hallway, a portion of a wall, etc., and a retracted position, wherein the covering 106 may be retracted relative to the roller tube 104. In the illustrated example, the covering 106 has an upper end or edge 117 (end or edge used interchangeably herein without the intent to limit) mounted to the roller tube 104 and a lower, free end or edge 119. Although not shown, an appropriate known or heretofore to be developed drive mechanism can be provided to move the covering 106 between the extended and retracted positions. In addition, the present disclosure is not limited to a particular roll-up direction, and the architectural-structure covering assembly 100 may be configured to operate in a conventional manner, or in a reverse-roll-up.

Referring to FIG. 1, for the sake of convenience and clarity, terms such as "front," "rear," "top," "bottom," "up," "down," "vertical," "horizontal", "inner," and "outer" may be used herein to describe the relative placement and orientation of various components and portions of the architectural-structure covering 100, each with respect to the geometry and orientation of the architectural-structure covering 100 as they appear in FIG. 1. Said terminology will include the words specifically mentioned, derivatives thereof, and words of similar import.

Figure 2:
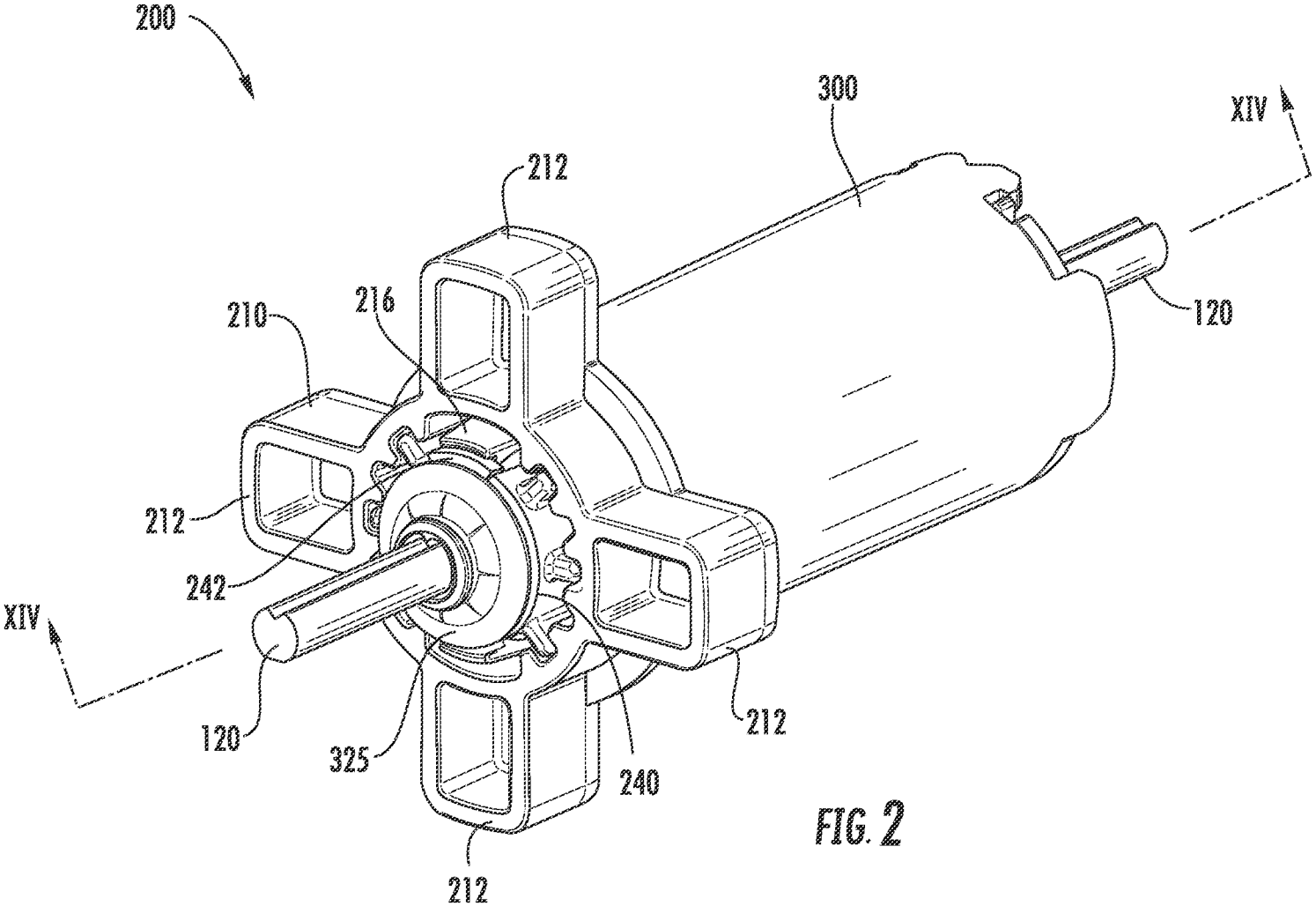
FIG. 2 is a front perspective view illustrating an example embodiment of a speed regulating assembly in accordance with an illustrative embodiment of the present disclosure.
Figure 3:
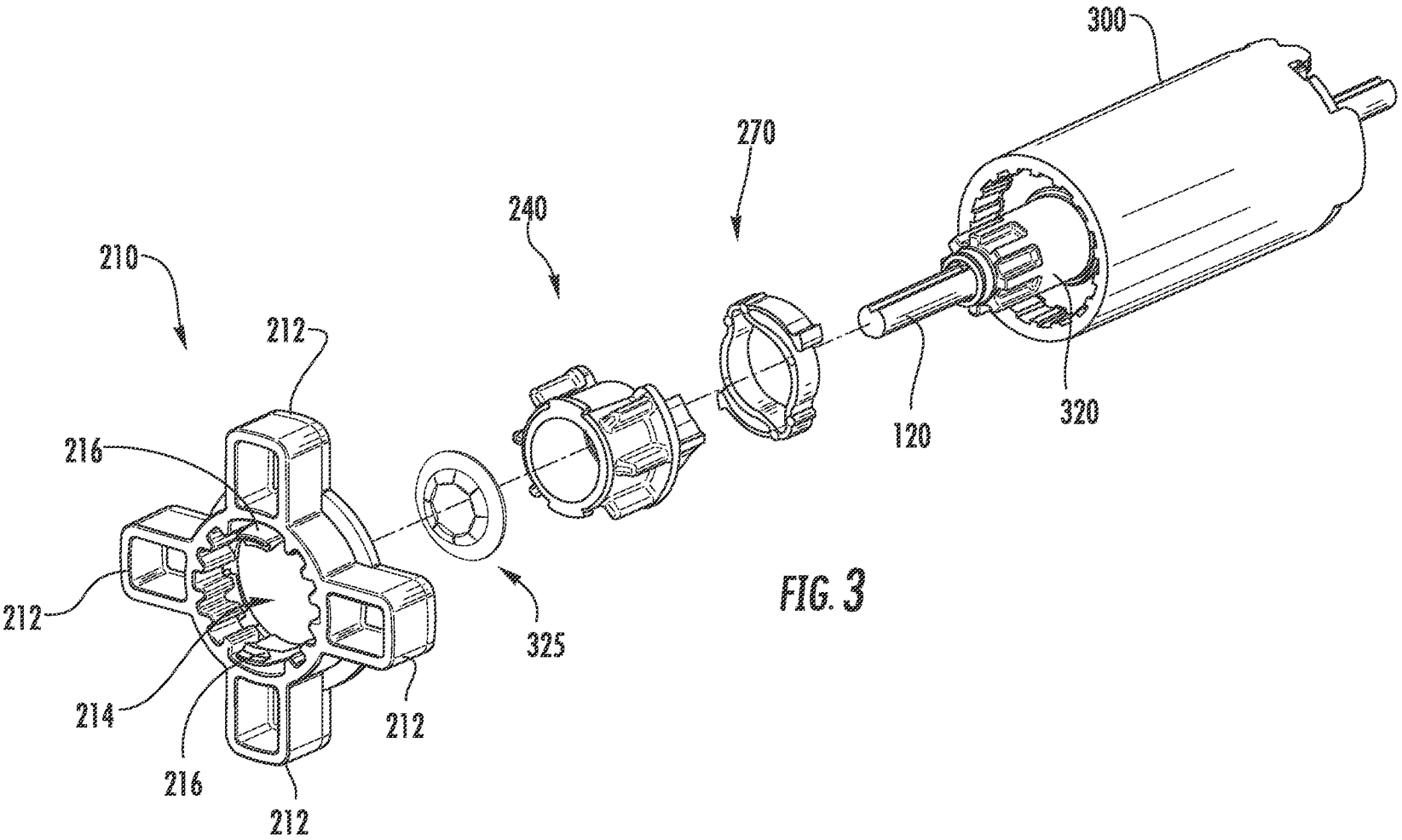
FIG. 3 is a front exploded, perspective view illustrating the speed regulating assembly shown in FIG. 2.
Figure 4:
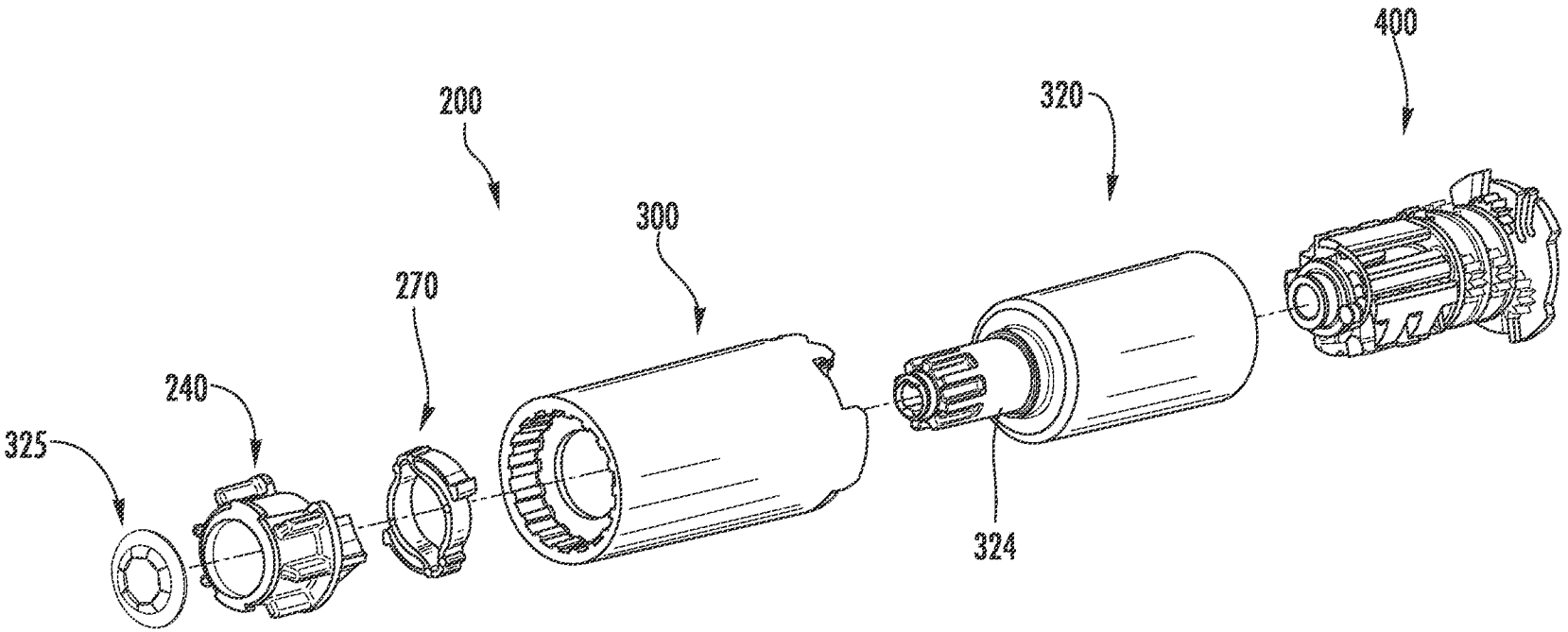
FIG. 4 is an alternate front, exploded, perspective view illustrating the speed regulating assembly shown in FIG. 2.

Referring now to FIGS. 2-4, a speed regulating assembly 200 according to an example embodiment of the present disclosure will now be described. In use, the speed regulating assembly 200 is located within, and coupled to, the roller tube 104 for regulating the deployment speed of the covering 106. The roller tube 104 is associated with or mounted to a non-rotatable central shaft 120. The non-rotatable central shaft 120 may be fixedly coupled to, for example, the endcaps 110, 112. In use, the non-rotatable central shaft 120 remains stationary (e.g., does not rotate) and is used, for example, to mount the speed regulating assembly 200 within the roller tube 104. It should be noted, that the speed regulating device 200 of the present disclosure may also be used in combination with a stacking shade. If so, in this embodiment, the adapter 210 would be arranged and configured to remain rotationally stationary, and the central shaft 120 would be allowed to rotate to enable the operating cords of the architectural-structure covering to be wound up and down.

As shown in FIGS. 2-4, in accordance with an illustrative, non-limiting embodiment of the present disclosure, the speed regulating assembly 200 includes an adapter 210, a cam bushing 240, a clutch element 270, a first housing 300, a second or speed regulating housing 320, and a speed regulating device 400. In addition, the speed regulating assembly 200 may include a locking collar or push-nut 325 for axially securing the position of the speed regulating assembly 200 on the shaft 120.

Figure 5:
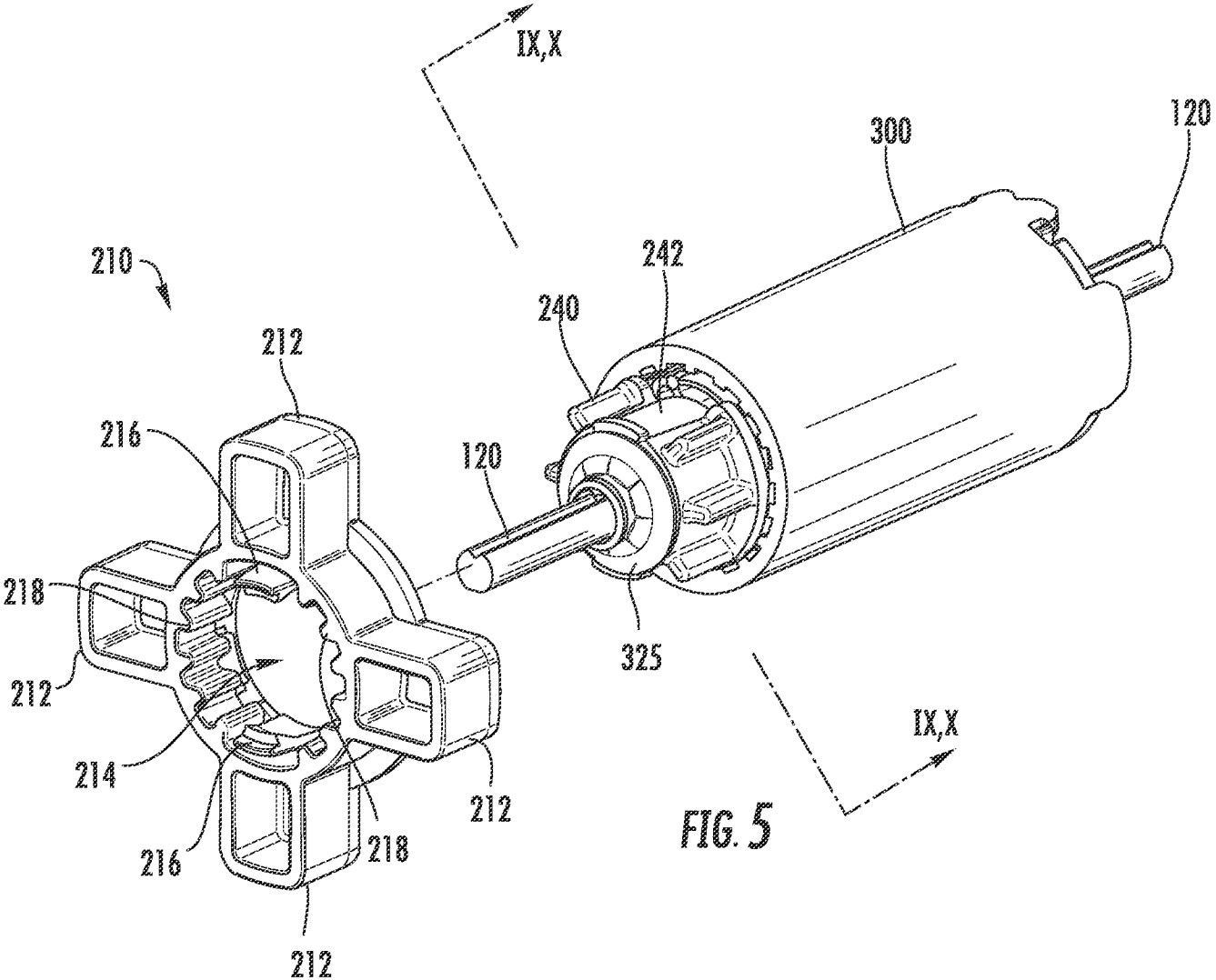
FIG. 5 is an alternate front, exploded perspective view illustrating the speed regulating assembly shown in FIG. 2.

In use, in the illustrated, example embodiment, the adapter 210 is coupled to the roller tube 104, for example, the inner surface (not shown) of the roller tube 104. The adapter 210 may be coupled to the roller tube 104 by any mechanism now known or hereafter developed including, for example, an adhesive, a fastener, a friction-fit, etc. Referring to FIGS. 2, 3, and 5, the adapter 210 includes one or more radially extending arms 212 for mating with corresponding arms or grooves (not shown) associated with the roller tube 104. While four arms 212 are illustrated, it is envisioned that more or fewer arms 212 may be used without departing from the disclosure. In this manner, rotation of the roller tube 104 causes the adapter 210 to rotate in a corresponding direction (e.g., clockwise rotation of the roller tube 104 rotates the adapter 210 in a clockwise direction).

Referring to FIGS. 2 and 5, the adapter 210 is coupled to the cam bushing 240. The adapter 210 may be coupled to the cam bushing 240 by any mechanism now known or hereafter developed. For example, in one embodiment, the adapter 210 may be snapped-fitted to the cam bushing 240. As shown, the adapter 210 includes a central opening 214 (FIG. 5) for receiving at least a portion of the cam bushing 240. For example, the cam bushing 240 may include a pair of catches 242 extending therefrom for coupling with a pair of radially biased spring members 216 extending into the central opening 214 of the adapter 210. In this manner, by pressing the adapter 210 onto the cam bushing 240 until the spring members 216 pass the pair of catches 242, the adapter 210 can be snap-fitted onto the cam bushing 240. While it has been described and illustrated that the catches are formed on the cam bushing 240 and the spring members are formed on the adapter 210, one of ordinary skill in the art will appreciate that this configuration may be reversed and the catches may be formed on the adapter 210 and the spring members may be formed on the cam bushing 240. In addition, while the cam bushing 240 and adapter 210 have been described as including a pair of spring members and catches, it is envisioned that more or fewer spring members and catches may be used without departing from the disclosure.

Figure 6:
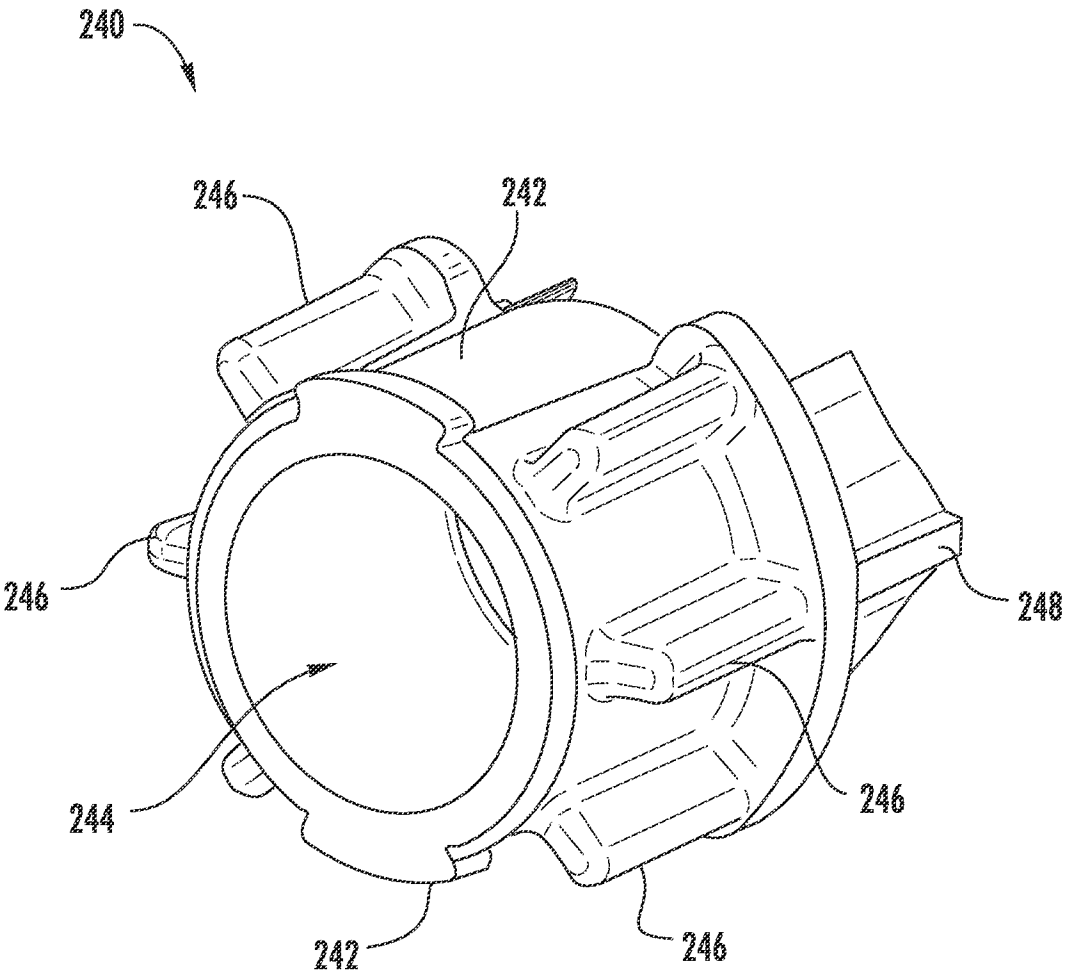
FIG. 6 is a front perspective view illustrating an example cam bushing used in connection with the speed regulating assembly shown in FIG. 2.
Figure 7:
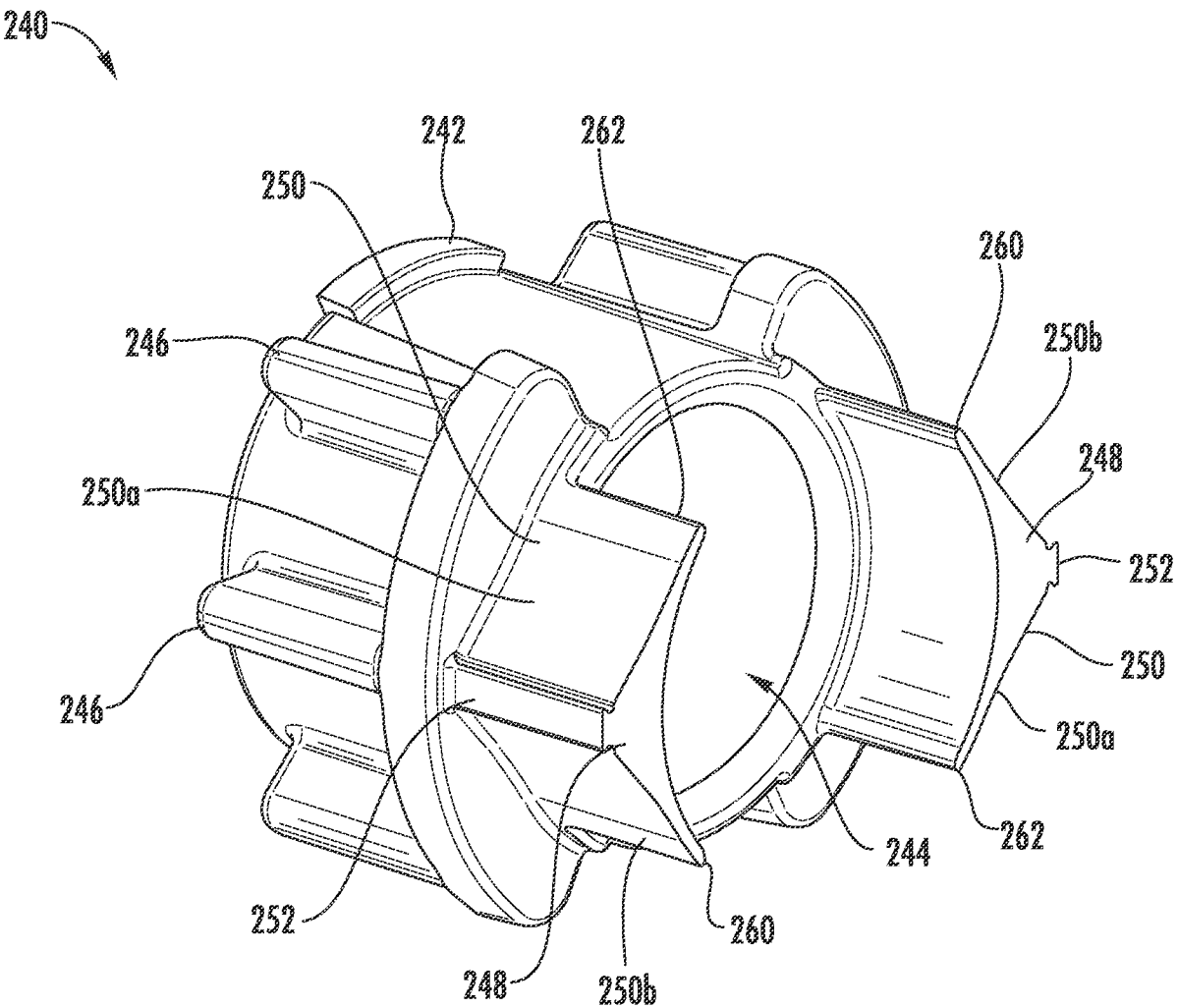
FIG. 7 is a rear perspective view illustrating the cam bushing shown in FIG. 6.

Referring to FIGS. 6 and 7, the cam bushing 240 includes a central opening 244 for receiving a portion of the second or speed regulating housing 320 (e.g., a stem portion 324 of the second or speed regulating housing 320 (FIG. 4)), as will be described in greater detail below. As previously mentioned, the cam bushing 240 may include a pair of catches 242 for facilitating coupling to the adapter 210. In addition, the cam bushing 240 may include a plurality of splines 246 extending outwardly therefrom for coupling to corresponding splines 218 (FIG. 5) located on and extending inwardly from the central opening 214 of the adapter 210. In this manner, the cam bushing 240 is rotatably coupled to the adapter 210 so that rotation of the adapter 210 is transferred to the cam bushing 240 (e.g., rotation of the adapter 210 via rotation of the roller tube 104 causes a corresponding rotation of the cam bushing 240).

Referring to FIG. 7, in the illustrated, example embodiment, the cam bushing 240 includes a pair of axially extending cam members 248 disposed on an end of the cam bushing 230 opposite to the end that engages the adapter 210. It is envisioned that more or fewer cam members 248 may be incorporated without departing from the disclosure. As shown, the cam members 248 include ramped surfaces 250 for contacting the clutch element 270, as will be described in greater detail below. As shown, each of the cam members 248 include a central portion (or apex) 252 and first and second ramped surfaces 250*a*, 250*b* diverging on opposite sides therefrom. In the illustrated embodiment, the first and second ramped surfaces 250*a*, 250*b* are generally flat, and they extend toward the central opening 244 as they extend away from the central portion 252. As will be described in greater detail below, during rotation of the cam bushing 240 via rotation of the roller tube 104 and the adapter 210, the cam members 248 interact with the clutch element 270 to engage or disengage the clutch element 270 with respect to the first housing 300 of the speed regulating assembly 200 depending on the direction of rotation.

The clutch element 270 may be any mechanism for transmitting rotation from the roller tube 104, the adapter 210, and the cam bushing 240, to the first housing 300 in a first direction (e.g., deployment direction) but not in a second direction (e.g., retraction direction). As will be described in greater detail below, the first housing 300 is rotationally coupled to the speed regulating device 400 so that rotation of the first housing 300 is transmitted to the speed regulating device 400. As such, during retraction of the covering 106, the clutch element 270 is disengaged from the first housing 300 so that rotation from roller tube 104 is not transferred to the first housing 300, and hence is not transferred to the speed regulating device 400. In this manner, the speed regulating device 400 has little to no impact on the covering 106 during retraction. During extension of the covering 106, the clutch element 270 engages the first housing 300 so that rotation from the roller tube 104 is transferred to the first housing 300, and hence is transferred to the speed regulating device 400. That is, the clutch element 270 may serve as a one-way clutch transferring torque from the roller tube 104 to the first housing 300 during deployment of the covering 106, while allowing free rotation of the roller tube 104 relative to the first housing 300 during retraction of the covering 106. In this manner, the speed regulating device 400 controls or limits the speed of the covering 106 during deployment.

Figure 8:
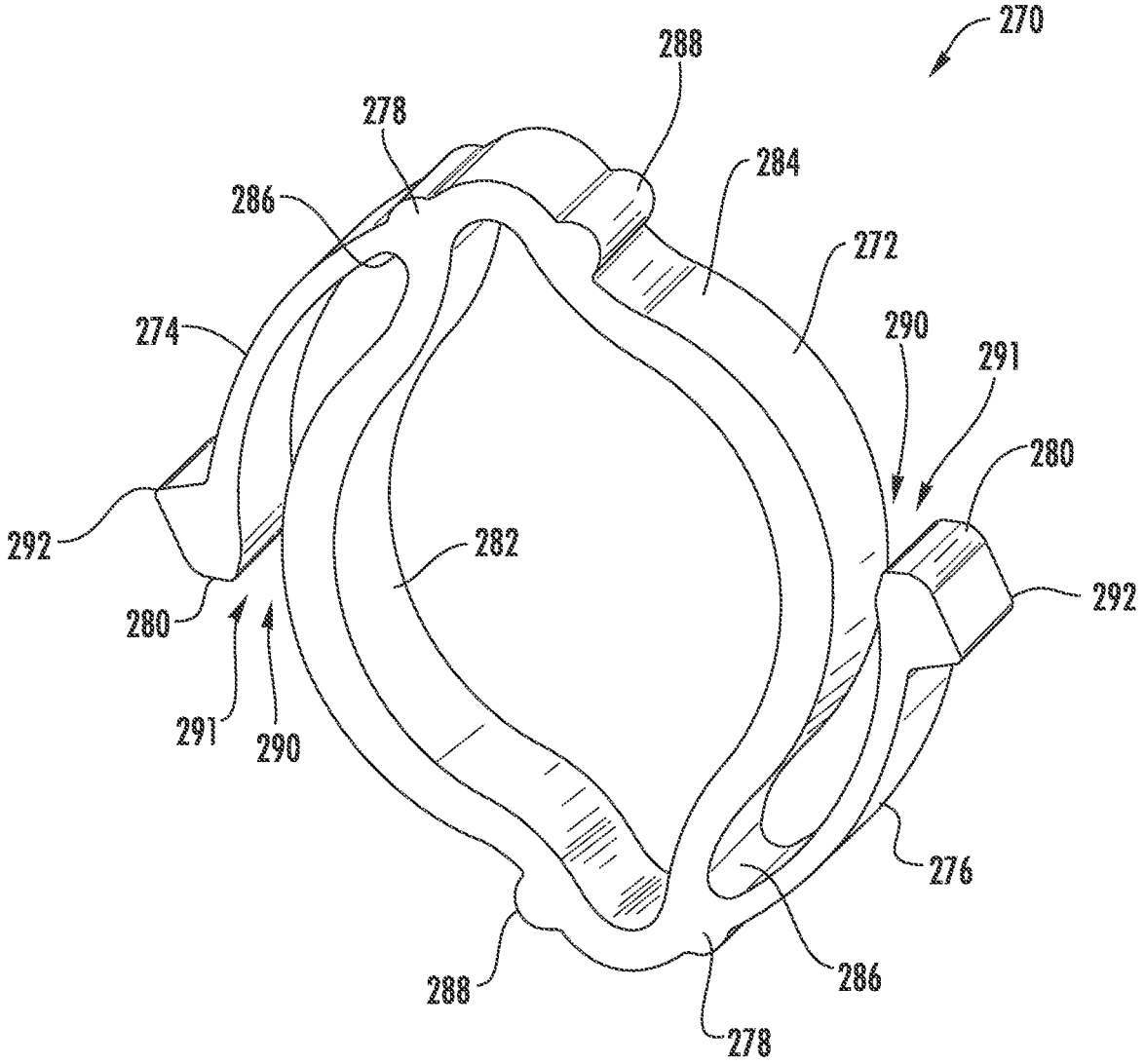
FIG. 8 is a front perspective view illustrating an example clutch element used in connection with the speed regulating assembly shown in FIG. 2.

The clutch element 270 may be any mechanism now known or hereafter developed including, for example, a wrap spring (not shown). Referring to FIG. 8, in the illustrated, example embodiment, the clutch element 270 includes a body 272 with first and second resilient arms 274, 276 each having a connected end 278 and a free end 280. Although it is envisioned that the clutch element 270 may have more or fewer number of resilient arms without departing from the disclosure. The body 272 includes an inner surface 282 and an opposing outer surface 284. The outer surfaces 284 includes shoulders, namely a first pair of (e.g., clockwise rotation) shoulders 286 and a second pair of (e.g., counterclockwise rotation) shoulders 288. These shoulders 286, 288 may comprise protrusions that extend outward from the generally smooth shape of the outer surfaces 284.

As shown, the resilient arms 274, 276 each wrap about the outer surface 284 in a radially spaced relationship and in a counterclockwise direction (as illustrated in FIG. 8) to loosely conform to the outer shape of the body 272. (It will be understood that the arms 274, 276 could alternatively be wrapped in a clockwise direction). Each of the resilient arms 274, 276, in combination with the outer surface 284, define a gap 290 closed at one end by the first pair (e.g., clockwise rotation) of shoulders 286 and open at the other, entrance end 291. The free end 280 of each of the arms 274, 276 may include an outward directed barb 292. When the speed regulating assembly 200 is assembled, the inner surface 282 of the body 272 rotatably bears against the second or speed regulating housing 320, as will be described in greater detail below.

Figure 9:
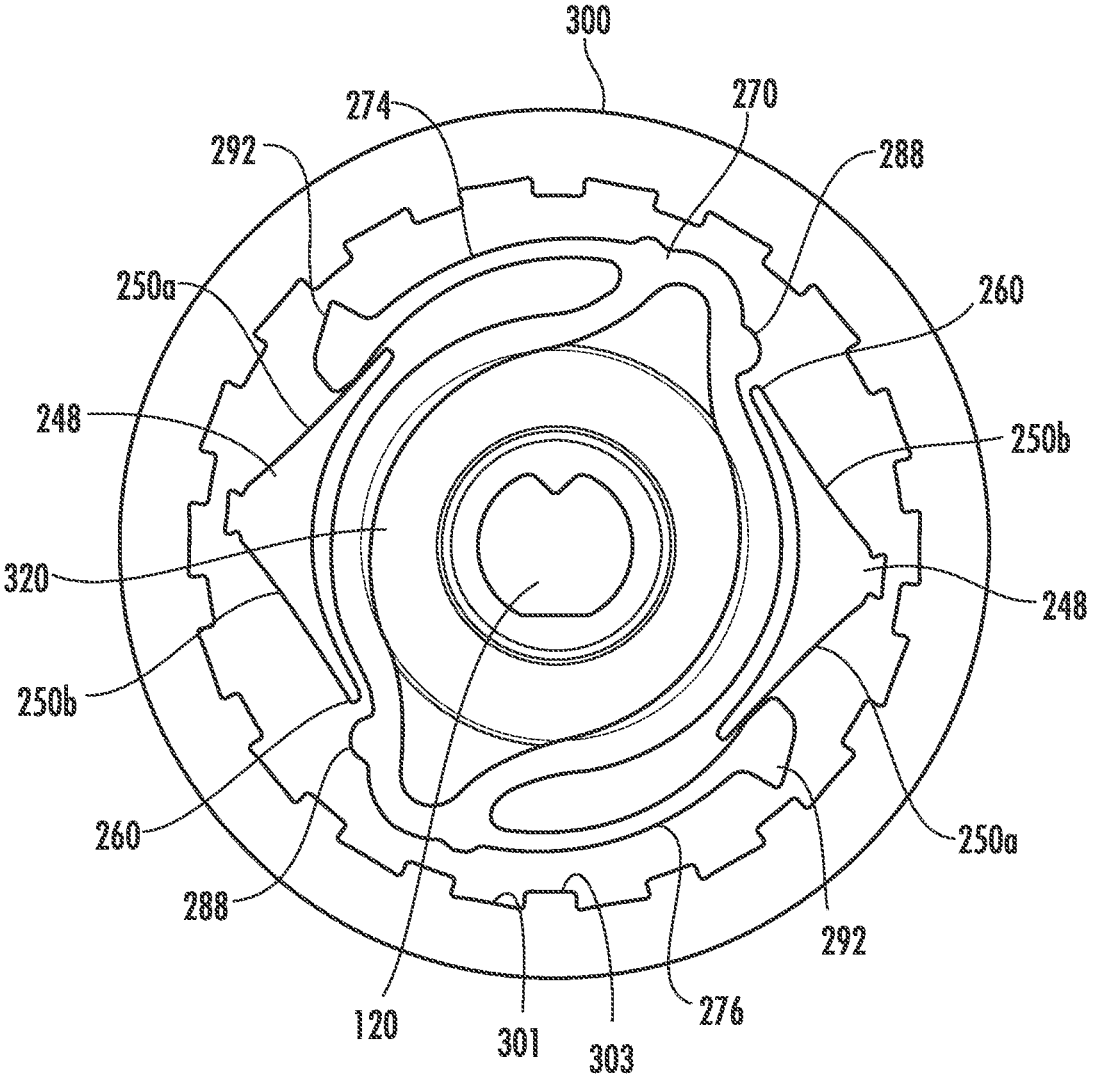
FIG. 9 is a cross-sectional view, taken along line IX-IX of FIG. 5, of the speed regulating assembly shown in FIG. 2 with the clutch element disengaged from the housing.
Figure 10:
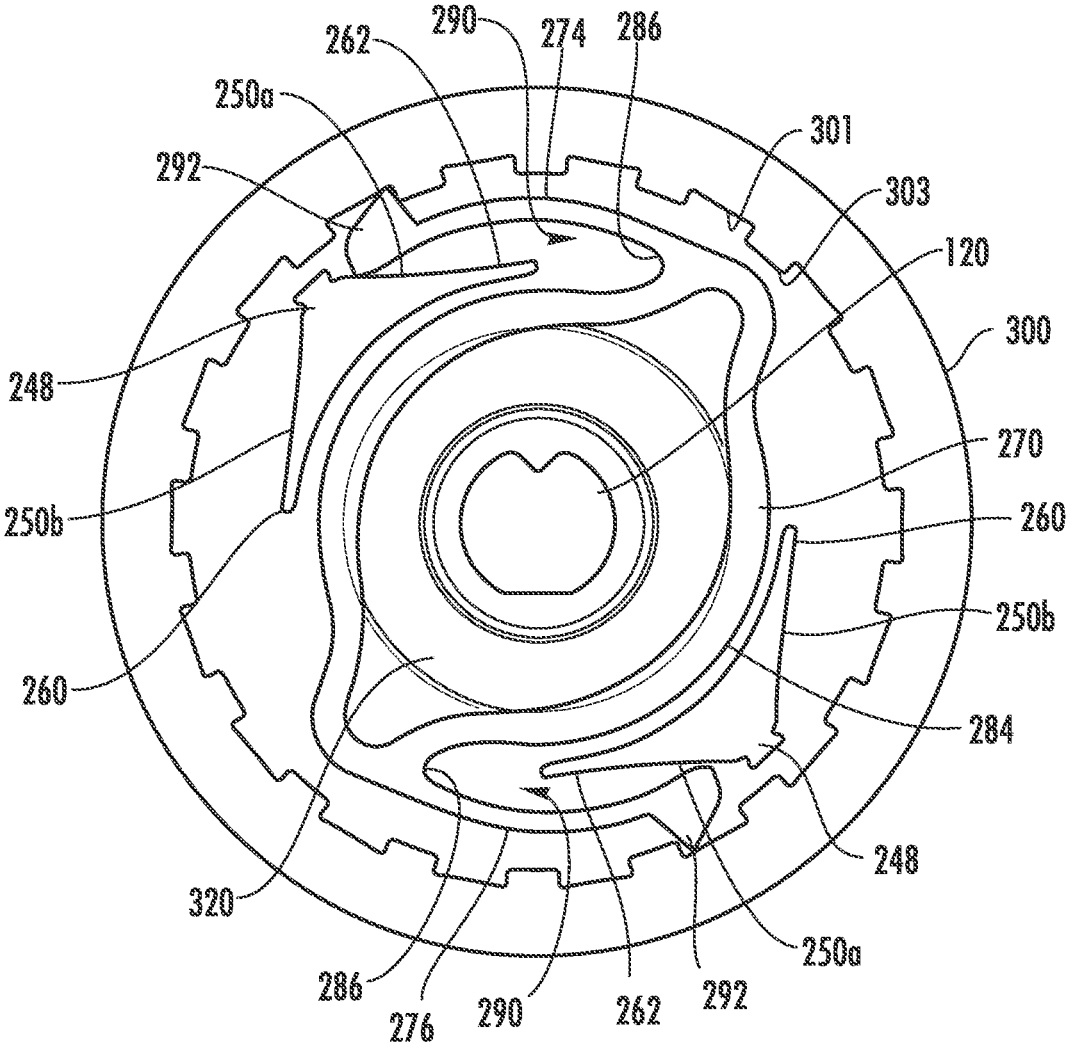
FIG. 10 is a cross-sectional view, taken along line X-X of FIG. 5, of the speed regulating assembly shown in FIG. 2 with the clutch element engaged with the housing.

Referring to FIGS. 9 and 10, as will be described in greater detail below, in one example embodiment, the clutch element 270 is axially positioned on the second or speed regulating housing 320 (e.g., preferably a smooth or non-threaded portion of the second or speed regulating housing 320). Referring to FIG. 9, during retraction of the covering 106, the roller tube 104 (FIG. 1) is rotated (e.g., counterclockwise rotation as illustrated in FIG. 9), which in turn rotates the adapter 210 due to the interconnecting radially extending arms 212 of the adapter 210 mating with corresponding arms or grooves associated with the roller tube 104, as previously described. Rotation of the adapter 210 causes the cam bushing 240 to rotate, which causes the clutch element 270 to rotate. As such, the roller tube 104, adapter 210, cam bushing 240, and clutch element 270 all rotate in unison. However, as illustrated in FIG. 9, during counterclockwise rotation, the clutch element 270 is in a disengaged or deactivated configuration whereby the clutch element 270 (e.g., the first and second resilient arms 274, 276 of the clutch element 270) is disengaged from the first housing 300 (e.g., the first and second resilient arms 274, 276 of the clutch element 270 do not engage the first housing 300 so that rotation is not transmitted to the first housing 300). That is, as illustrated, the first and second resilient arms 274, 276 of the clutch element 270 are in a non-expanded, relaxed or compressed state. As such, the first and second resilient arms 274, 276 of the clutch element 270 do not engage the inner surface of the first housing 300. In this manner, rotation of the clutch element 270 is not transferred to the first housing 300. In the disengaged or deactivated configuration, the cam members 248 contact the shoulders, namely the second pair of (e.g., counterclockwise) shoulders 288 formed on the clutch element 270. Thus, rotation (e.g., counterclockwise rotation as illustrated in FIG. 9) of the roller tube 104 rotates the adapter 210 (FIGS. 2, 3 and 5), which rotates the cam bushing 240 (FIGS. 2-5), which, as previously described, is coupled to the clutch element 270 and thus results in rotation of the clutch element 270. However, since the first and second resilient arms 274, 276 of the clutch element 270 do not engage the first housing 300, rotation from the clutch element 270 is not transmitted to the first housing 300, and as such, the first housing 300 remains stationary.

In the illustrated example embodiment, during retraction of the covering 106, the counterclockwise rotation (as illustrated in FIG. 9) of the roller tube 104, the adapter 210, and the cam bushing 240 causes the trailing edge 260 of each of the cam members 248 to contact the second pair of shoulders 288 formed on the clutch element 270. In this configuration, the resilient arms 274, 276 do not engage the first housing 300. For example, the resilient arms 274, 276 may reside in a non-expanded state, whereby the smaller effective outer diameter of the clutch element 270 is insufficient to engage with the first housing 300. Alternatively, the trailing edges 260 of the cam members 248 may contact the shoulders 288, thereby radially contracting inwardly, the resilient arms 274, 276, thereby decreasing the effective outer diameter of the clutch element 270. In any event, the resilient arms 274, 276 do not engage the first housing 300, and, as a result, rotation of the clutch element 270 is not transmitted to the first housing 300.

Once the trailing edges 260 of the cam members 248 contact the shoulder 288, the cam members 248 drive the clutch element 270 in the retraction direction. However, the decreased effective outer diameter of the clutch element 270 isolates the rotation of the clutch element 270 from the first housing 300 (e.g., the non-expanded state or decreased outer diameter of the clutch element 270 prevents the clutch element 270 from engaging the first housing 300, and thus, prevents rotation from the clutch element 270 from being transferred to the first housing 300).

Referring to FIG. 10, during deployment of the covering 106 (e.g., clockwise rotation of the roller as illustrated in FIG. 10), the clutch element 270 is in an engaged or activated configuration whereby the clutch element 270 (e.g., the first and second resilient arms 274, 276 of the clutch element 270) is engaged with the first housing 300. In the engaged or activated configuration, the cam members 248 are now positioned within the gap 290 located between the first and second resilient arms 274, 276 and the outer surface 284. Thus, rotation (e.g., clockwise rotation) of the cam bushing 240 causes the cam members 248 (e.g., ramped surface 250*a*) to interact with the first and second resilient arms 274, 276 thereby forcing the first and second resilient arms 274, 276 outwards and into engagement with the first housing 300. For example, the barbs 292 formed on the free end 280 of the first and second resilient arms 274, 276 may engage projections 303 formed on an inner surface 301 of the first housing 300. As a result, in the engaged or activated configuration, rotation (e.g., clockwise rotation) of the roller tube 104 results in rotation of the adapter 210, which rotates the cam bushing 240, which rotates the clutch element 270, which is in engagement with and thus rotates the first housing 300, and, as will be described in greater detail below, results in rotation of the speed regulating device 400.

In the illustrated example embodiment, during deployment of the covering 106, rotation of the cam bushing 240 moves the clockwise leading edge 262 of each of the cam members 248 radially between the resilient arms 274, 276 and the outer surface 284 of the clutch element 270 and towards the first pair of (e.g., clockwise rotational) shoulders 286 located at the intersection of the resilient arms 274, 276 and the body 272 of the clutch element 270. As the leading edges 262 of the cam members 248 move toward the shoulder 286, the resilient arms 274, 276 ride up the ramped surfaces 250*a* of the cam members 248 and are expanded radially outward, thereby increasing the effective outer diameter of the clutch element 270, which causes the resilient arms 274, 276 to engage the first housing 300 (e.g., projections 303 formed on the inner surface 301 of the first housing 300). Thus configured, continued rotation of the cam bushing 240 and the clutch element 270 causes rotation of the first housing 300.

Figure 11:
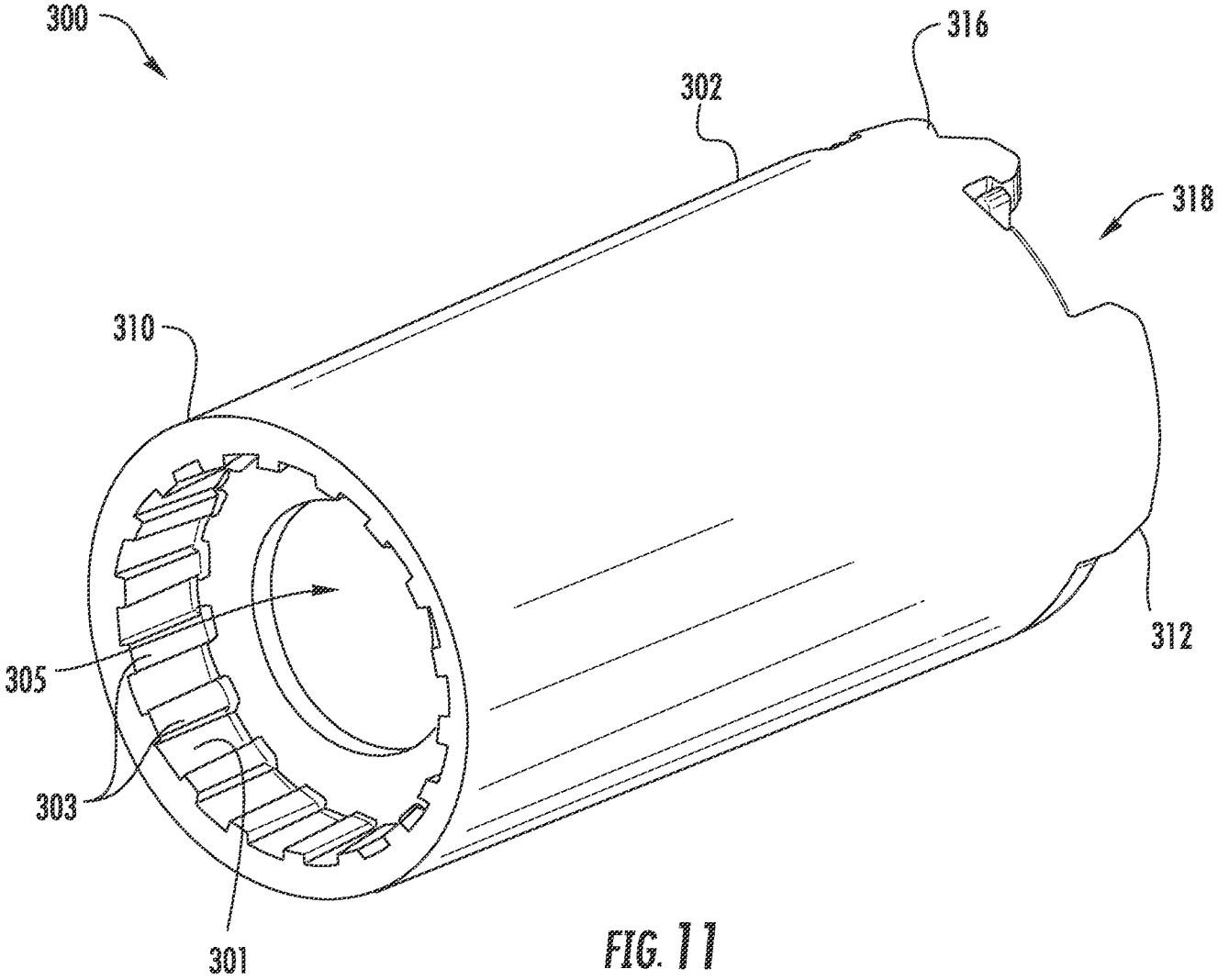
FIG. 11 is a front perspective view illustrating an example first housing used in connection with the speed regulating assembly shown in FIG. 2.

Referring to FIG. 11, an example embodiment of the first housing 300 is illustrated. As illustrated, the first housing 300 may have a generally cylindrical body portion 302, although it is envisioned that the first housing 300 may have other shapes. As illustrated, the first housing 300 includes a first end 310, a second end 312, and a hollow interior cavity 314 (FIG. 14).

Figure 14:
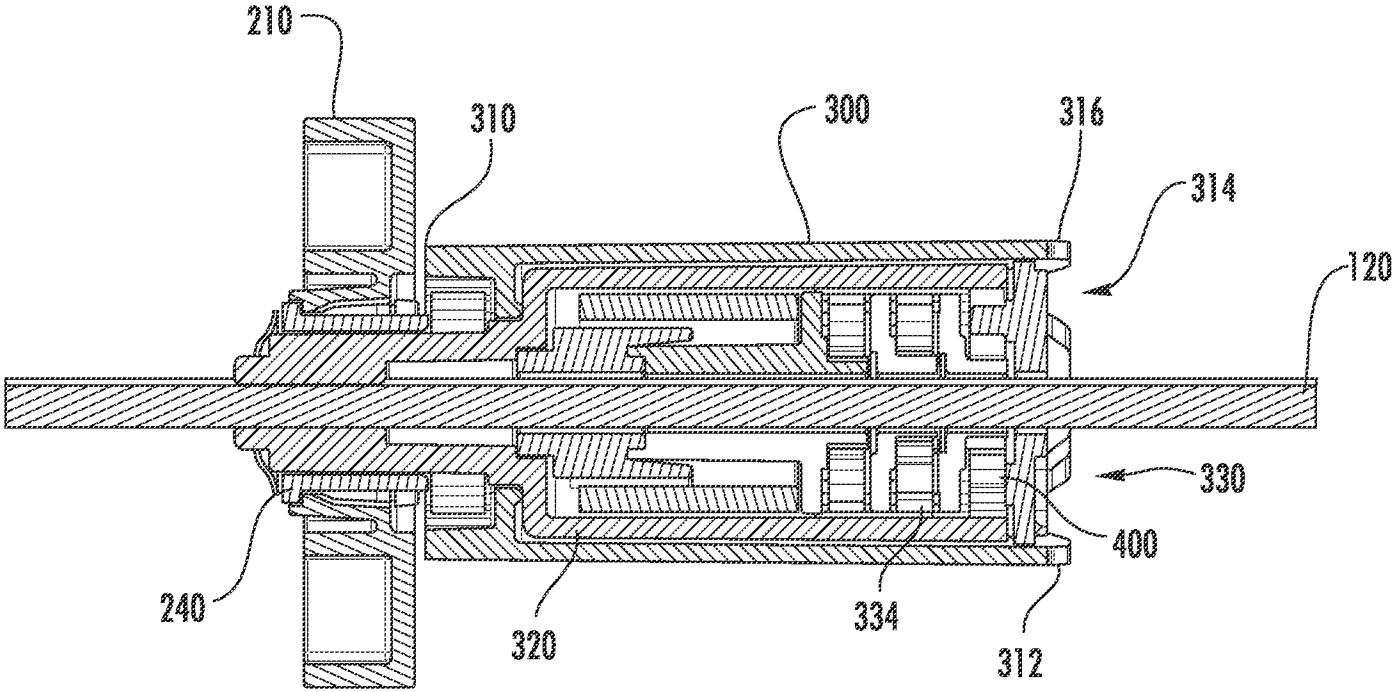
FIG. 14 is a longitudinal cross-sectional view, taken along line XIV-XIV of FIG. 2, illustrating the speed regulating assembly shown in FIG. 2.

In the illustrated example embodiment, the hollow interior cavity 314 of the first housing 300 is arranged and configured for receiving the second or speed regulating housing 320 and the speed regulating device 400 therein (as illustrated in FIG. 14). The first housing 300 is rotationally coupled to the speed regulating device 400 so that rotation of the first housing 300 is transmitted to the speed regulating device 400. The first housing 300 may be rotationally coupled to the speed regulating device 400 by any means now known or hereafter developed. As shown, the second end 312 of the first housing 300 includes a plurality of axially extending arms 316 and notches 318 for coupling to corresponding mating surfaces on the speed regulating device 400.

As previously mentioned, in the illustrated, example embodiment, the first end 310 of the first housing 300 includes a plurality of inwardly facing projections 303 extending from the inner surface 301 of the first housing 300 for selectively coupling with the resilient arms 274, 276 of the clutch element 270 depending on the direction of rotation. In addition, the first housing 300 includes a central opening 305 for passing the shaft 120 and at least a portion of the second or speed regulating housing 320 therethrough.

Figure 12:
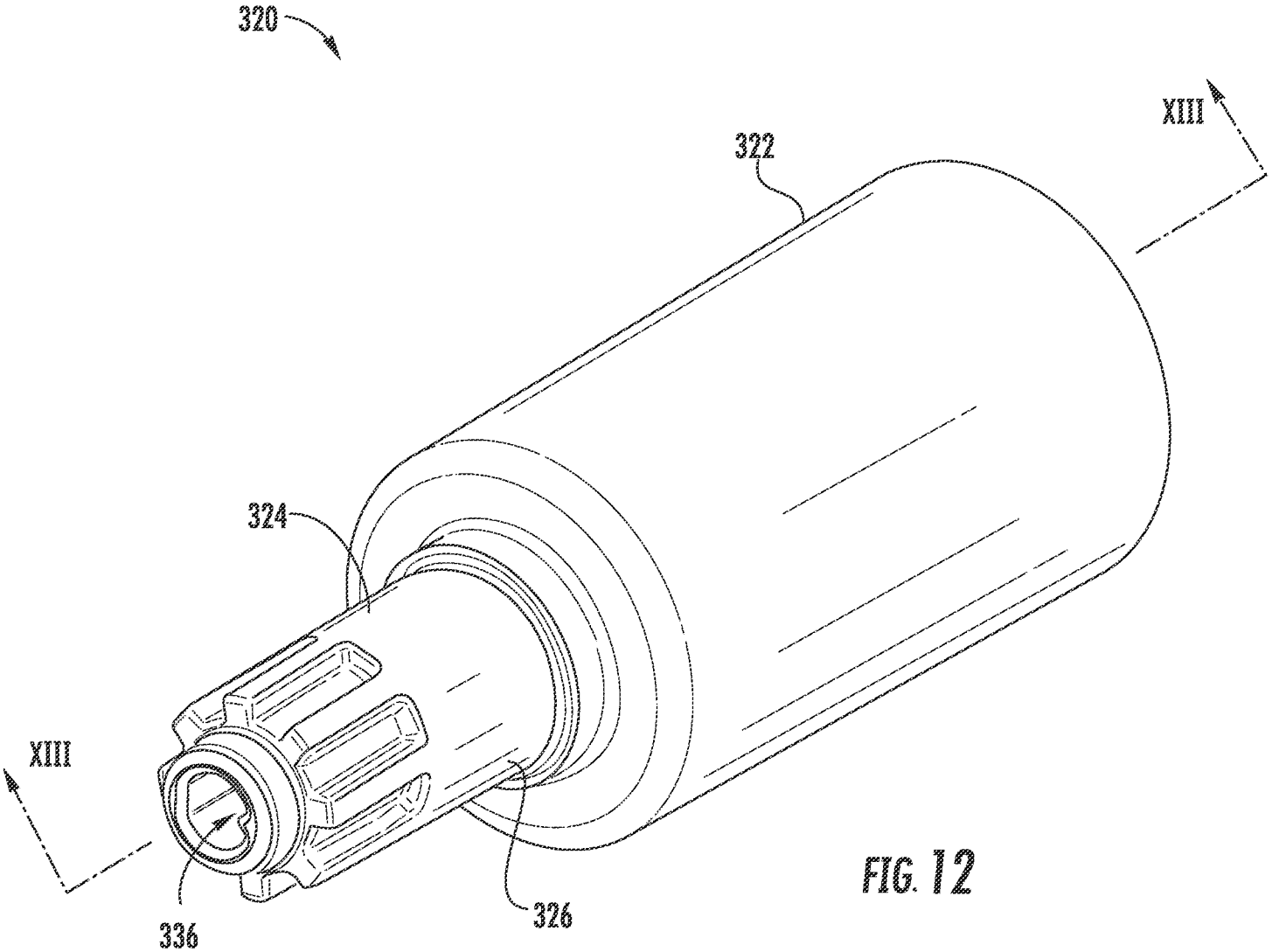
FIG. 12 is a front perspective view illustrating an example second or speed regulating housing used in connection with the speed regulating assembly shown in FIG. 2.
Figure 13:
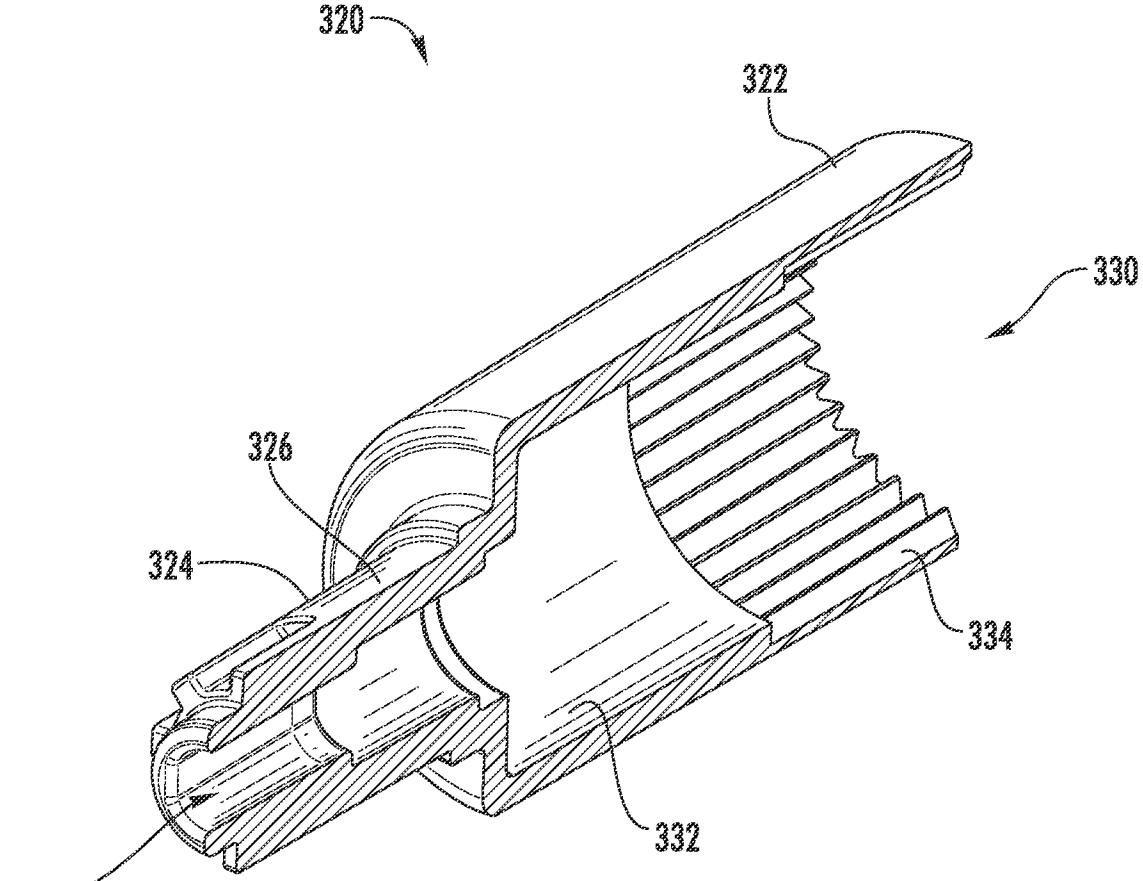
FIG. 13 is a longitudinal cross-sectional view, taken along line XIII-XIII of FIG. 12, illustrating the second or speed regulating housing shown in FIG. 12.

Referring to FIGS. 12 and 13, an example embodiment of the second or speed regulating housing 320 is illustrated. As illustrated, the second or speed regulating housing 320 has a generally cylindrical body portion 322, although it is envisioned that the second or speed regulating housing 320 may have other shapes. As previously mentioned, in the illustrated, example embodiment, the second or speed regulating housing 320 includes a stem portion 324 extending axially away from the body 322. The stem portion 324 may include a smooth portion 326 for receiving the clutch element 270.

Referring to FIG. 13, in the illustrated, example embodiment, the body 322 of the second or speed regulating housing 320 includes a hollow interior cavity 330 for receiving the speed regulating device 400 therein. The interior cavity 330 of the second or speed regulating housing 320 includes a first portion 332 and a second portion 334. In use, the first portion 332 may be smooth while the second portion may include a plurality of gears for coupling with the speed regulating device 400. That is, in use, the smooth first portion 332 enables circumferential sliding of the speed regulating device 400 while the second, geared portion 334 engages the speed regulating device 400, for example, planetary gears of the speed regulating device 400 to drive the speed regulating device 400. In this manner, the faster the roller tube 104 rotates, the greater the drag on the speed regulating device 400 to limit the deployment speed of the covering.

In addition, the stem portion 324 of the second or speed regulating housing 320 may include a central opening 336 for passing the shaft 120 therethrough. In use, the central opening 336 may be keyed to the central shaft 120 so that the second or speed regulating housing 320 is rotationally fixed with respect to the central shaft 120 and the first housing 300 (e.g., the second or speed regulating housing 320 does not rotate with respect to the central shaft 120 or the first housing 300).

As previously mentioned, the speed regulating device 400 may be any now known or hereafter developed device for regulating, for example, the speed of the covering during deployment. For example, as illustrated and described herein, the speed regulating device may include a planetary gear system positioned within a housing. Alternatively, it is envisioned that the speed regulating device 400 may be in other forms.

As described herein, the speed regulating assembly 200 may be coupled to the roller tube 104 using an interchangeable adapter. By incorporating an interchangeable adapter, the speed regulating assembly 200 enables a singular speed regulating device 400 to be used regardless of the size or inner diameter of the roller tube 104. That is, in contrast to prior art devices, where the speed regulating device, for example, the speed regulating housing, directly couples to the inner surface of the roller tube 104 so that any change in diameter of the roller tube 104 requires a different speed regulating device to be used, the speed regulating assembly 200 may include a detachable adapter 210 arranged and configured to couple to the inner surface of the roller tube 104. As such, any change in the size of the roller tube 104 only requires a different sized adapter 210.

That is, by utilizing an adapter that is removably coupled to a speed regulating assembly, any change in the size or diameter of the roller tube only requires a different sized adapter. In this manner, the manufacturer does not need to maintain an independent and separate speed regulating device for each roller tube size. Rather, a singular speed regulating device may be used regardless of the size or inner diameter of the roller tube. As such, in use, as the size of the roller tube changes, the manufacturer can merely decouple the adapter from the speed regulating assembly and replace it with one sized for coupling to the roller tube. In this manner, a single speed regulating device may be used for all roller tube sizes, and, for example, a manufacturer may build, store, etc. a single speed regulating device regardless of the size or inner diameter of the roller tube, thus minimizing the number of different items required to be stocked.

In addition, as described herein, the speed regulating assembly 200 is arranged and configured so that, in use, during retraction of the covering 106, the speed regulating assembly 200 may be disengaged so that any input rotation from the roller tube 104 is not transmitted to the speed regulating device 400. As such, the speed regulating device 400 has no influence during retraction of the covering 106. However, during deployment of the covering 106, the speed regulating assembly 200 may be engaged so that any input rotation from the roller tube 104 is transmitted to the speed regulating device 400. As such, during deployment of the covering 106, the speed regulating device is engaged to control or limit the speed of deployment of the covering 106.

While the present disclosure makes reference to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of shades, in addition to the roller shades described and depicted herein. Similarly, it should be appreciated that the concepts disclosed herein may apply to many types of operating systems, in addition to the operating system described and depicted herein. For example, the concepts may apply equally to any type of architectural-structure covering having a covering movable across an architectural structure. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

The invention claimed is:

1. A speed regulating assembly for use in an architectural-structure covering to couple to a roller tube to regulate a speed of a covering portion of the architectural-structure covering, said assembly comprising:

a speed regulating device;

an adapter arranged and configured to be coupled to the roller tube so that rotation of the roller tube is transmitted to said adapter, wherein said adapter is detachably coupleable to said speed regulating device so that said adapter can be selectively coupled and decoupled from said speed regulating device; and a cam bushing for coupling to said adapter, said cam bushing being rotatably coupled to said adapter so that rotation of said adapter is transferred to said cam bushing.

2. The assembly of claim 1, wherein said adapter includes a plurality of radially extending arms for coupling with an inner surface of the roller tube.

3. The assembly of claim 1, further comprising an architectural-structure covering including:

a covering portion; and a roller tube coupled to said covering portion for retracting and deploying said covering portion.

4. The assembly of claim 1, wherein said adapter is coupled to said cam bushing via a snap-fit connection.

5. The assembly of claim 1, wherein said cam bushing includes a plurality of splines extending outwardly therefrom for coupling to corresponding splines located on said adapter.

6. The assembly of claim 1, wherein said speed regulating assembly is arranged and configured so that when said adapter is rotated in a first direction, said assembly is in an activated configuration such that any input rotation to said adapter is transmitted to said speed regulating device; and when said adapter is rotated in a second direction, said assembly is in a deactivated configuration such that any input rotation to said adapter is not transmitted to said speed regulating device.

7. The assembly of claim 6, further comprising a clutch element, said clutch element being rotationally coupled to said adapter via said cam bushing so that rotation of said adapter is transferred to said clutch element, said clutch element being selectively coupled to said speed regulating device so that rotation of said clutch element is transmitted to said speed regulating device when in said activated configuration.

8. The assembly of claim 7, wherein, when in said deactivated configuration, said clutch element is rotationally disengaged with respect to said speed regulating device so that rotation of said clutch element is not transmitted to said speed regulating device.

9. The assembly of claim 8, wherein said cam bushing includes a pair of axially extending cam members, wherein:

rotation of said cam bushing in said first direction causes said cam members to interact with said clutch element so that said clutch element is rotationally coupled to said speed regulating device; and rotation of said cam bushing in said second direction causes said cam members to interact with said clutch element so that said clutch element is rotationally disengaged from said speed regulating device.

10. The assembly of claim 9, wherein said clutch element includes:

a body including an outer surface, and first and second resilient arms each arm having a connected end, and a free end; and a first pair of shoulders, and a second pair of shoulders formed on said outer surface of said body.

11. The assembly of claim 10, further comprising a first housing, wherein:

when in said deactivated configuration, said cam members contact said second pair of shoulders formed on said body of said clutch element, said first and second resilient arms remaining in a non-expanded state and, as such, do not engage said first housing; and when in said activated configuration, said cam members interact with said first and second resilient arms to force said first and second resilient arms outwards into engagement with said first housing so that rotation of said clutch member rotates said first housing.

12. The assembly of claim 11, wherein said first and second resilient arms each include a barb located at said free end thereof, in said activated configuration, said barbs engaging projections formed on an inner surface of said first housing.

13. The assembly of claim 11, wherein, when in said activated configuration, said cam members are positioned within gaps located between said outer surface and respective ones of first and second resilient arms causing said first and second resilient arms to expand radially outward, thereby increasing an effective outer diameter of said clutch element.

14. The assembly of claim 11, further comprising a second housing, said first housing including a hollow interior cavity for receiving at least a portion of said second housing and at least a portion of said speed regulating device.

15. The assembly of claim 14, wherein said first housing is rotationally coupled to said speed regulating device so that rotation of said first housing is transmitted to said speed regulating device.

16. The assembly of claim 14, wherein said second housing includes a hollow interior cavity for receiving at least a portion of said speed regulating device therein, at least a portion of an inner surface of said interior cavity of said second housing including a plurality of gears for coupling with said speed regulating device.

17. The assembly of claim 14, wherein said second housing includes a stem portion extending through an opening formed in said first housing, said stem portion receiving said clutch element and said cam bushing thereon.

18. The assembly of claim 14, further comprising a central shaft for mounting said assembly within the roller tube, wherein said second housing is keyed to said central shaft so that said second housing is rotationally fixed with respect to said central shaft and said first housing.

19. A speed regulating assembly for use in an architectural-structure covering to couple to a roller tube for regulating a speed of a covering portion of the architectural-structure covering, said assembly comprising:

a tube-engaging element for coupling to the roller tube;

a speed regulating engaging element for coupling to a speed regulating device, said speed regulating engaging element including a clutch element rotationally coupled to said tube-engaging element;

wherein said speed regulating assembly has an activated configuration and a deactivated configuration, in said activated configuration, said clutch element is rotationally coupled to said speed regulating device so that rotation of the roller tube in a first direction is transmitted to said clutch element via said tube-engaging element, rotation of said clutch element is transmitted to said speed regulating device so that rotation of said tube-engaging element is transferred to said speed regulating device; and in said deactivated configuration, said clutch element is rotationally disengaged from said speed regulating device so that rotation of the roller tube in a second direction, opposite the first direction, is not transmitted to said speed regulating device so that rotation of said tube-engaging element is not transferred to said speed regulating device.

20. The assembly of claim 19, wherein said tube-engaging element is an adapter, said adapter being arranged and configured to couple to the roller tube so that rotation of the roller tube is transmitted to said adapter.

21. The assembly of claim 20, wherein said adapter is a detachable adapter so that said adapter can be selectively coupled and decoupled from said assembly.

22. The assembly of claim 19, wherein said speed regulating engaging element further includes a cam bushing, said cam bushing includes a pair of axially extending cam members, wherein:

rotation of said cam bushing in said first direction causes said cam members to interact with said clutch element so that said clutch element is rotationally coupled to said speed regulating device; and rotation of said cam bushing in said second direction causes said cam members to interact with said clutch element so that said clutch element is rotationally disengaged from said speed regulating device.

23. The assembly of claim 22, wherein said clutch element includes:

a body including an outer surface, and first and second resilient arms each arm having a connected end, and a free end; and a first pair of shoulders, and a second pair of shoulders formed on said outer surface of said body.

24. The assembly of claim 23, further comprising a first housing, wherein:

when in said deactivated configuration, said cam members contact said second pair of shoulders formed on said body of said clutch element, said first and second resilient arms remaining in a non-expanded state and, as such, do not engage said first housing; and when in said activated configuration, said cam members interact with said first and second resilient arms to force said first and second resilient arms outwards into engagement with said first housing so that rotation of said clutch member rotates said first housing.

25. The assembly of claim 24, wherein said first and second resilient arms each include a barb located at said free end thereof, in said activated configuration, said barbs engaging projections formed on an inner surface of said first housing.

26. The assembly of claim 24, wherein, when in said activated configuration, said cam members are positioned within gaps located between said outer surface and respective ones of first and second resilient arms causing said first and second resilient arms to expand radially outward, thereby increasing an effective outer diameter of said clutch element.

27. The assembly of claim 24, further comprising a second housing, said first housing including a hollow interior cavity for receiving at least a portion of said second housing and at least a portion of said speed regulating device.

28. The assembly of claim 27, wherein said first housing is rotationally coupled to said speed regulating device so that rotation of said first housing is transmitted to said speed regulating device.

29. The assembly of claim 27, wherein said second housing includes a hollow interior cavity for receiving at least a portion of said speed regulating device therein, at least a portion of an inner surface of said interior cavity of said second housing including a plurality of gears for coupling with said speed regulating device.

30. The assembly of claim 27, wherein said second housing includes a stem portion extending through an opening formed in said first housing, said stem portion receiving said clutch element and said cam bushing thereon.

31. The assembly of claim 27, further comprising a central shaft for mounting said assembly within the roller tube, wherein said second housing is keyed to said central shaft so that said second housing is rotationally fixed with respect to said central shaft and said first housing.

* * * * *